United States Patent [19]

Lindberg

[11] Patent Number: 4,742,744

[45] Date of Patent: May 10, 1988

[54] HOLE PUNCHING DEVICE

[76] Inventor: Bo E. Lindberg, Iggebygatan 7, S-720 02 VästerÅs, Sweden

[21] Appl. No.: 14,064

[22] PCT Filed: Apr. 29, 1986

[86] PCT No.: PCT/SE86/00199

§ 371 Date: Dec. 17, 1986

§ 102(e) Date: Dec. 17, 1986

[87] PCT Pub. No.: WO86/06674

PCT Pub. Date: Nov. 20, 1986

[30] Foreign Application Priority Data

May 3, 1985 [SE] Sweden ..... 8502178

[51] Int. Cl.[4] ..... B26F 1/32

[52] U.S. Cl. ..... 83/167; 83/588; 83/618

[58] Field of Search ..... 83/588, 618, 620, 627, 83/691, 701, 167

[56] References Cited

U.S. PATENT DOCUMENTS

| | | | |
|---|---|---|---|
| 3,906,633 | 9/1975 | Inoue | 83/618 |
| 4,166,404 | 9/1979 | Almog | 83/618 |

FOREIGN PATENT DOCUMENTS

| | | | |
|---|---|---|---|
| 1063575 | 8/1959 | Fed. Rep. of Germany . | |
| 2306221 | 8/1973 | Fed. Rep. of Germany | 83/701 |
| 2618211 | 11/1977 | Fed. Rep. of Germany | 83/588 |
| 3135786 | 2/1984 | Fed. Rep. of Germany . | |
| 3339742 | 5/1985 | Fed. Rep. of Germany | 83/167 |

*Primary Examiner*—E. R Kazenske
*Assistant Examiner*—Hien H. Phan
*Attorney, Agent, or Firm*—Banner, Birch, McKie & Beckett

[57] ABSTRACT

A device for manual hole punching of sheet material is made up from extruded profiles, one forming a cover (1), which is movable towards a bottom part (2) formed from two combined sections (7,8). The cover carries punches (22) running in holes (23). A counter-acting spring bias is obtained by spring means (25) inserted between the cover and bottom part.

6 Claims, 2 Drawing Sheets

Figure 3:
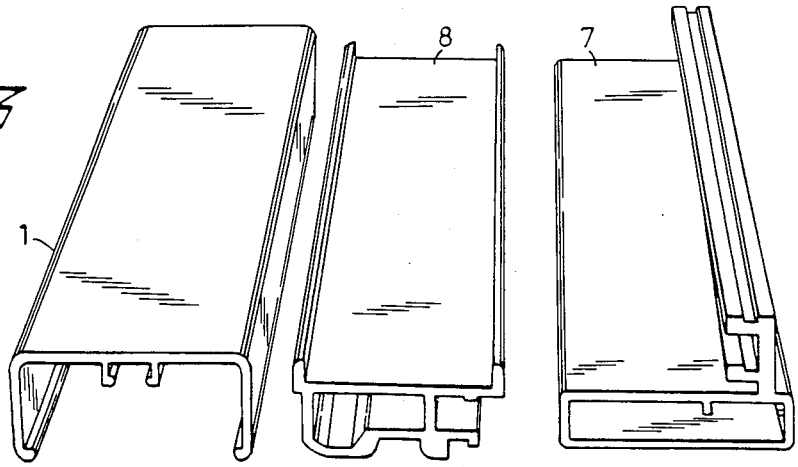

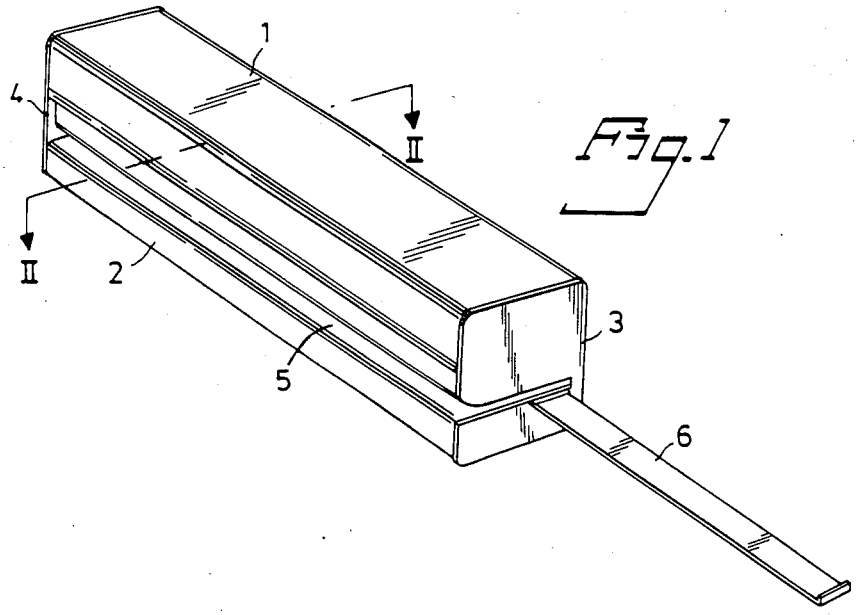
Fig. 1
Fig. 2
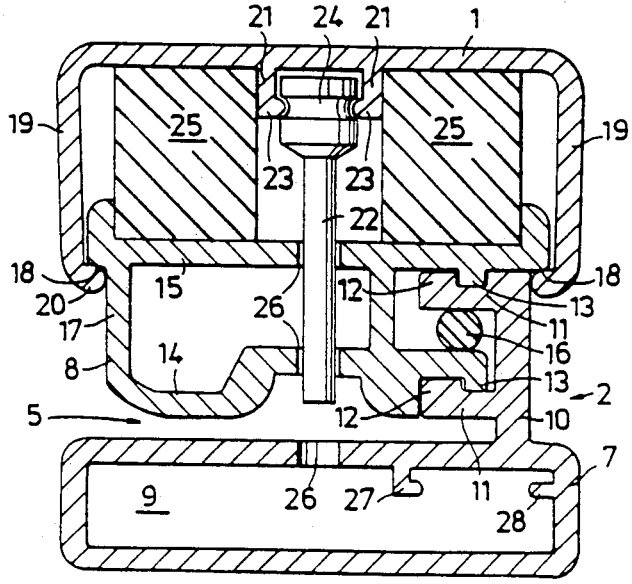

HOLE PUNCHING DEVICE

TECHNICAL FIELD

The present invention relates to a device for manually punching holes in sheets of paper and the like. The device includes a bottom part, carrying a overshaped movably mounted operative member, to which there are attached at least two punches in register with corresponding holes in the bottom part, the operative member being adapted for pressing down towards the bottom part by two mutually opposing legs on the member being guided in side walls arranged on the bottom part for causing the punches to pass through a sheet insertion slit arranged in the bottom part.

BACKGROUND ART

Such hole punching devices are well known, and are often implemented in pressed sheet metal, e.g. according to the German published specification 1 063 575, the different parts being welded or riveted to each other. With regard to this, assembly work is difficult and requires many work operations which cause the finished product to be more expensive.

It is also known to implement hole punches which work according to a swinging arm principle. Here there are problems with regard to oblique loading on the punches, the downward press movement of which is caused by the swinging movement of the operative member. Such a device is known, e.g. from the German patent No. 3,135,786. The hole punch device recited in this patent is constructed from extruded sections and has a pressure plate or a cover which is mounted as a simple lever. The punch, mounted with the aid of a spring in the bottom part of the device, has a sliding surface for coaction with the inside of the cover. A troublesome shear stress occurs in the punch for the turning movement carried out by the cover during punching operations, and to obtain a trouble-free axial movement the punch must be accommodated in a long guide hole with tight tolerances. In turn, this means troublesome problems with high friction between the punch body and the long guide hole Known hole punch devices furthermore have a deficiency in that it is not possible to adjust the punches for different hole spacing. This is extremely troublesome for manufacturers intending to sell the device on different markets, since there are so many different standards with respect to hole spacing. The manufacturers have thus been compelled to manufacture and stock hole punches with different hole and punch spacing, which of course also makes the product more expensive.

DISCLOSURE OF INVENTION

The above-mentioned disadvantages are surmounted with a device in accordance with the present invention. This is characterized in that the operative member includes a cover with a substantially C-shaped cross section, the opposing legs of which coact with at least one abutment on the side walls of the bottom part for limiting the upward movement of the lid and defining its rest position. The punches are attached to the ceiling of the cover with means extending in the longitudinal direction of the cover. Spring bias is generated by spring means which are arranged in the lid on either side of the attachment means of the punches and engage against the surfaces facing towards each other on the lid and bottom part.

In a preferred embodiment of the hole punch in accordance with the invention, the bottom part comprises a foot unit forming a closed space for punch roundels, and along one long side it has a web provided with bulbed flanges which are fixable on correspondingly formed strips on an intermediate unit associated with the bottom part. Fixation can here take place with an elastic locking means inserted between opposing surfaces on one of the flanges and one of the strips, respectively. This embodiment is well suited for being produced from extruded sections. Accordingly, the cover, foot and intermediate units may be manufactured from such sections, which are relatively cheap from the manufacturing aspect.

With this implementation, manufacture of a hole punch will be particularly simple, since it is not necessary to resort to welding or riveting Furthermore, if desired, the foot and intermediate units of the bottom part may be provided with a large number of holes mutually forming different hole spacing corresponding to different standards applicable to different markets. The punches are removably fixed in the fastening means of the lid, and the punches can thus be set against the hole spacing prevailing at the moment.

PREFERRED EMBODIMENT

Figure 5:
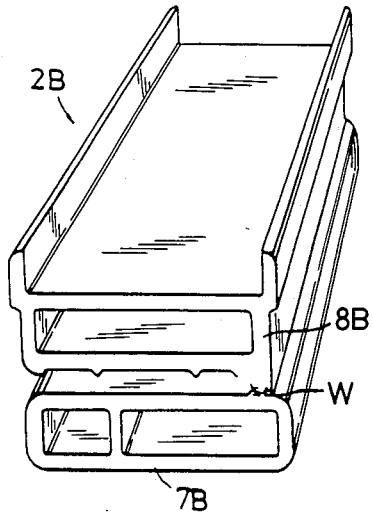
Figure 4:
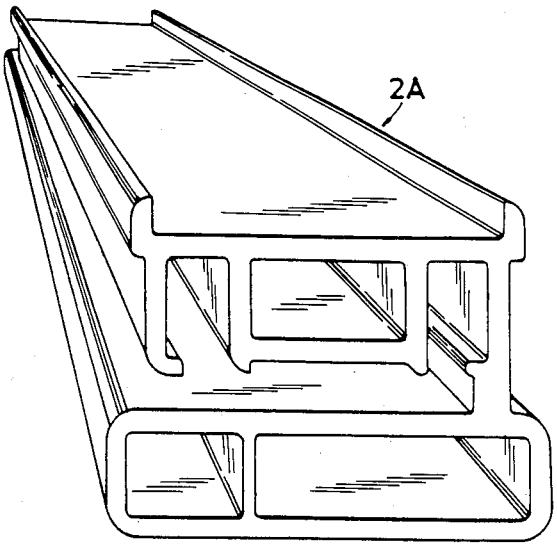

The invention will now be described in detail in connection with a preferred embodiment and with reference to the accompanying drawings, on which FIG. 1 is a perspective view of a hole punch in accordance with the invention, FIG. 2 is a section II—II according FIG. 1, FIG. 3 illustrates the parts from which a hole punch in accordance with the invention is made, and FIG. 4 and 5 illustrate modified embodiments of sections for the bottom part of the hole punch.

As will be seen from FIGS. 1 and 2, the device for manual hole punching has, in a preferred embodiment, an elongate shape. The device includes a cover 1, bottom part 2 and end walls 3, 4. A sheet insertion slit 5 is made in the bottom part 2. The end walls, exemplified in FIG. 1 by the end wall 3, may have a corresponding slit if the hole punch is to be provided with a setting plate 6, as is the case in the illustrated embodiment The setting plate 6 is withdrawably mounted in the bottom part 2 for conventionally enabling adjustment for sheets of different sizes.

It will be seen from FIG. 2, which is a section II—II according to FIG. 1, how the device is constructed. The bottom part 2 is formed from two units, namely a foot unit 7 and an intermediate unit 8. The foot unit 7 has a closed space 9 for accommodating punch roundels. A web 10 is formed on the ceiling of the space 9 along one long side of the foot unit 7. The web 10 has two fastening flanges 11 parallel to the ceiling, and each having a bulb 12, the bulbs being directed in the same direction.

The fastening flanges 11 and their bulbs 12 on the foot unit 7 are intended to coact with strips 13 correspondingly formed on the intermediate unit 8. The intermediate unit 8 thus has two flat portions 14, 15, each having a strip 13. The lower flat portion 14 is inserted on assembly of the hole punch in the space between the fastening flanges 11, simultaneously as an elastic locking means 16 is arranged between the lower flat portion 14 and the upper fastening flange 11. The foot and intermediate units 7 and 8 will accordingly be firmly fixed to each other and between them form the sheet insertion slit 5.

Both flat portions 14 and 15 of the intermediate unit 8 are united with each other by transverse walls 17. The upper flat portion 15 projects out past the side edges formed by one of the transverse walls 17 of the intermediate unit 8 and the upright 10, abutments 18 thus being formed. These abutments 18 coact with the cover 1, which is acted on by upwardly directed spring bias, the cover having along its lower edge inwardly directed stop means 20 on each side surface 19.

On the inside of the ceiling of the foot unit 7, there is a bulbed strip 27 formed to thrust into the space 9. Together with a bead 28 formed on the adjacent side wall, this bulbed strip 27 is intended to carry the optional setting plate 6 (FIG. 1).

As will be seen from FIG. 2, the cover 1 has a substantially C-shaped cross section. The ceiling of the cover 1 has fastening means 21 for an optional number of punches 22. The fastening means 21 comprise two axially parallel flanges, the free ends of which each have a bulb 23 directed towards the other flange. The bulbs 23 engage in a recess 24 on the fastening portion of each punch 22.

On the side facing away from the punch, the fastening means 21 form a support for the spring means 25 exerting the upwardly directed spring bias on the cover 1.

Each punch is assigned a hole 26, which is made by boring through both flat portions 14, 15 of the intermediate unit 8 and the ceiling of the foot unit 7. In an unoperated state, i.e. in the rest position of the hole punch, the punch 22 extends down through the holes in both flat portions 14, 15, such as to be moved past the sheet insertion slit 5 on operating the hole punch by depressing the cover 1 against spring bias, the punch continuing down into the corresponding hole in the ceiling of the foot unit 7.

Three extruded sections, preferably of aluminium, are illustrated in FIG. 3, for use in fabricating the cover 1, foot unit 7 and intermediate part 8. The locking means 16 is advantageously made from rubber, and the spring means 25 of an elastomer of substantially the same length as the cover 1. Both end walls 3, 4 are advantageously made of compression moulded plastics with a configuration corresponding to the cross section of the hole punch. By providing the plastics end walls with suitable beads or the like, they can be removeably fastened to the bottom part 2.

The embodiment described above of the hole punch in accordance with invention has thus a bottom part 2, comprising the assembled intermediate and foot units 8 and 7. The sections for these units may be modified for assembly with an interference fit, the locking means 16 then no longer being needed. In FIGS. 4 and 5, there are illustrated modified sections 2A and 2B for the bottom part 2 of the hole punch. In this case the sections illustrated in FIGS. 2 and 3 for the intermediate unit 8 and foot unit 7 are replaced by a single section 2A or 2B, whereby all assembly work for the bottom part 2 is dispensed with.

This single section can be formed by extrusion moulding as a single part, or alternatively by extrusion moulding two sections 7B, 8B, which can be rolled together at W, according to FIG. 5.

The inventive hole punch may thus be realized in different ways within the scope of the invention. Apart from its being possible to give the bottom part 2 different embodiments, the diameters of the punches 22 may vary, and thus be even greater than the width between the fastening means 21. Furthermore, the punches 22 may, of course, be centrally attached to the ceiling of the cover, but the fastening means 21 may also be displaced in parallel relative the central axis of the cover so that the punches are given a laterally displaced fixation. The invention may therefore not be regarded as limited to what has been described above and illustrated on the accompanying drawings.

I claim:

1. A device for manually punching holes in paper sheets and the like, including a bottom part (2) having a pair of sidewalls (10,17) and a hole (26), an operative member (1) mounted on said bottom part for movement toward and from the same and including two opposed legs (19) cooperating with said sidewalls for guiding said operative member as it moves relative to said bottom part, a punch (22), means for mounting said punch on said operative member for endwise movement relative to said bottom part and for passing through said hole upon movement of said operative member in the direction toward said bottom part, said device having a sheet inserting slit (5) passing between said hole and said punch, spring means (25) acting between said operative member and said bottom part for biasing the operative member in the direction away from said bottom part, and means (18) for limiting movement of said punch and said operative member in the direction away from said bottom part, said means for mountint said punch on said operative member comprising two opposed parallel flanges on said operative member and having bulbs (23), said punch having a circumferential recess adapted to receive said bulbs for movement of said punch longitudinally of said operative member while retaining said punch against movement endwise relative to said operative member.

2. A device as claimed in claim 1 in which said spring means (25) comprises a block of elastic material.

3. A device as claimed in claim 1 in which said bottom part (2) and said operative member (1) are each formed from an extruded section.

4. A device as claimed in claim 1 in which said bottom part (2) is provided with a plurality of holes spaced along the same, said operative member (1) having a plurality of punches (22) adapted to pass selectively through said holes.

5. A device for manually punching holes in paper sheets and the like, including a bottom part (2) having a pair of sidewalls (10,17) and a hole (26), an operative member (1) mounted on said bottom part for movement toward and from the same and including two opposed legs (19) cooperating with said side walls for guiding said operative member as it moves relative to said bottom part, a punch (22), means for mounting said punch on said operative member for endwise movement relative to said bottom part and for passing through said hole upon movement of said operative member in the direction toward said bottom part, said device having a sheet inserting slit (5) passing between said hole and said punch, spring means (25) acting between said operative member and said bottom part, and mean (18) for limiting movement of said punch and said operative member in the direction away from said bottom part, said bottom part (2) including a foot unit (7) and an intermediate unit (8) between which the sheet inserting slit (5) is formed, said foot unit (7) being formed with a closed space (9) for collecting punch roundels, and a pair of spaced parallel flanges (11) projecting from one (10) of said sidewalls and adapted to coact with said intermediate unit for securing said intermediate unit to said foot unit.

6. The device as claimed in claim 5 in which said operative member (1), said foot unit (7) and said intermediate unit (8) are each formed from extruded sections.

* * * * *